US007586466B2

(12) United States Patent
Kwon et al.

(10) Patent No.: US 7,586,466 B2
(45) Date of Patent: Sep. 8, 2009

(54) DISPLAY PANEL INCLUDING AN IMPROVED ELECTRODE STRUCTURE

(75) Inventors: Jae-Ik Kwon, Asan-si (KR); Seok-Gyun Woo, Asan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 636 days.

(21) Appl. No.: 10/921,829

(22) Filed: Aug. 20, 2004

(65) Prior Publication Data

US 2005/0052357 A1 Mar. 10, 2005

(30) Foreign Application Priority Data

Aug. 23, 2003 (KR) ..... 10-2003-0058504

(51) Int. Cl.
*G09G 3/28* (2006.01)

(52) U.S. Cl. ..... 345/60; 315/169.4; 313/582

(58) Field of Classification Search ..... 345/60–68; 315/169.4, 169.1; 313/581–584
See application file for complete search history.

(56) References Cited

U.S. PATENT DOCUMENTS 6,531,819 B1 * 3/2003 Nakahara et al. ..... 313/582
6,549,180 B1 * 4/2003 Yoo et al. ..... 313/582
6,747,414 B2 * 6/2004 Yoshida ..... 315/169.1
6,812,640 B2 * 11/2004 Setoguchi ..... 313/582

FOREIGN PATENT DOCUMENTS

JP 2003-086107 3/2003

* cited by examiner

*Primary Examiner*—Kevin M Nguyen
(74) *Attorney, Agent, or Firm*—H.C. Park & Associates, PLC

(57) ABSTRACT

A display panel with an improved electrode structure including a cross region in which a plurality of first electrodes and a plurality of second electrodes are arranged to cross each other. A display cell is formed at each cross region. The display panel has an electrode structure in which a first electrode protrusion is formed in the direction of the arrangement of the second electrode and adjacent first electrode protrusions have different arrangements at adjacent cross regions.

11 Claims, 8 Drawing Sheets

DISPLAY PANEL INCLUDING AN IMPROVED ELECTRODE STRUCTURE

This application claims the benefit of Korean Patent Application No. 2003-58504, filed on Aug. 23, 2003, which is hereby incorporated by reference for all purposes as if fully set forth herein.

BACKGROUND OF THE INVENTION

1. Field of the Invention

The present invention relates to a display panel, and more particularly to a display panel with an electrode structure that enhances stable addressing.

2. Discussion of the Related Art

A typical display panel includes a panel unit and a drive unit.

FIG. 1 shows a typical structure for a 3-electrode surface discharging type plasma display panel (PDP). FIG. 2 shows how a single cell of the panel of FIG. 1 operates.

Referring to FIG. 1 and FIG. 2, address electrode lines (A1, A2, . . . , Am), dielectric layers 102 and 110, Y electrode lines (Y1, . . . , Yn), X electrode lines (X1, . . . , Xn), fluorescent layers 112, barrier walls 114 (not shown in FIG. 2), and a protective layer 104 are located between the front and rear glass substrates 100 and 106 of a typical surface discharging PDP 1.

The address electrode lines (A1, A2, . . . , Am) are formed on top of the rear glass substrate 106 in a regular pattern. A dielectric layer 110 is coated on top of the address electrode lines (A1, A2, . . . , Am). The barrier walls 114 are formed on top of the dielectric layer 110 in parallel with the address electrode lines (A1, A2, . . . , Am). These barrier walls 114 partition the discharge spaces of each display cell and prevent optical interference between display cells. The fluorescent layers 112 are formed between the barrier walls 114.

The X electrode lines (X1, . . . , Xn) and the Y electrode lines (Y1, . . . , Yn) are formed under the front glass substrate 100 in a regular pattern, orthogonal to the address electrode lines (A1, A2, . . . , Am), where each intersection corresponds to a display cell. Each X electrode line (X1, . . . , Xn) and Y electrode line (Y1, . . . , Yn) can be formed by combining transparent electrode lines (Xna, Yna) made of a transparent conductive material such as Indium Tin Oxide (ITO) with metal electrode lines (Xnb, Ynb), which enhance conductivity. The dielectric layer 102 covers the X electrode lines (X1, . . . , Xn) and Y electrode lines (Y1, . . . , Yn). A protective layer 104, which may be made of Mgo and protects the panel 1 from a strong electric field, covers the dielectric layer 102. A plasma producing gas is injected into the discharge cells 108 before the PDP is sealed.

The typical driving method for a PDP as described above allows initialization, address, and display sustaining stages to be sequentially performed in a unit sub-field. The electric charges of the display cells that are to be driven are uniform during the initialization stage. Electric charges for selected and non-selected display cells are determined during the address stage. Display discharge is performed in display cells during the display sustaining stage. During a cell discharge, plasma is formed from the display cell's plasma producing gas and ultraviolet rays produced by the plasma excite the fluorescent layers 112 of the display cells to create light.

In this case, since several unit sub-fields are included in a unit frame, a desired gradation can be displayed by the display sustaining time of each sub-field.

FIG. 3 illustrates a common drive device for the PDP 1 of FIG. 1.

Referring to FIG. 3, a common PDP drive device includes an image processor 300, a logic controller 302, an address driver 306, an X driver 308, and a Y driver 304. The image processor 300 converts an external analog image signal to a digital signal and creates an internal image signal, for example, 8 bit red (R), green (G), and blue (B) image data, a clock signal, and vertical and horizontal synchronizing signals. The logic controller 302 creates drive control signals ($S_A$, $S_Y$, $S_X$) according to the internal image signals coming from the image processor 300. The address driver 306 processes the address signals ($S_A$) to create display data signals and applies these display data signals to the address electrode lines (A1, A2, . . . , Am). The X driver 308 processes the X drive control signal ($S_X$) and applies it to the X electrode lines. The Y driver 304 processes a Y drive control signal ($S_Y$) and applies it to the Y electrode lines.

FIG. 4 shows a plan view of one example of the panel shown in FIG. 1 with a structure including black stripes 416 and transparent electrode lines (Xna, Yna) that are divided in each discharge cell by barrier walls 414 and are formed extending from metal electrode lines (Xnb, Ynb). The electrode structure illustrated in FIG. 4 may obtain a highly efficient discharge by eliminating unnecessary parts of the transparent electrode line (Xna, Yna) that are located on the barrier walls 414. Additionally, black stripes 416 can be included in the spaces between unit cells to enhance display panel contrast.

With the address electrode 500 structure shown in FIG. 5*a*, in order to increase the width of the discharge surface (C) at which the address electrode 500 and scanning (Y) electrode cross each other, the address electrode 500 width must be increased correspondingly. However, increasing the width of the address electrode increases the power needed for addressing discharge cells. This is the cause of high power consumption when presenting low gradation and reproducing moving pictures.

A protruded address electrode structure as shown in FIG. 5*b* may be provided to solve such problems. A protrusion 504 is included to function during address discharge and is located on the discharge surface where the address electrode (A) and scanning (Y) electrode cross each other. Additionally, address electrode portions other than the protrusion 504 are made of a relatively thin conductor material. Therefore, in addition to securing a sufficient address discharge area for stable discharge, the overall power consumption may be maintained. However, in the electrode structure of FIG. 5*b*, since the protrusions 504 are formed in parallel along the scanning electrode (Y), neighboring address electrodes may create electrical interference in an area indicated by reference number 506.

SUMMARY OF THE INVENTION

Accordingly, the present invention is directed to a display panel including an improved electrode structure that substantially obviates one or more of the problems due to limitations and disadvantages of the related art.

The present invention provides a display including an improved protruded electrode structure reducing power consumption and providing a stable discharge quality.

Additional features of the invention will be set forth in the description which follows, and in part will be apparent from the description, or may be learned by practice of the invention.

The present invention discloses a display panel comprising a plurality of first electrodes that cross a plurality of second electrodes to form cross regions at which display cells are formed. First electrode protrusions are formed at the cross regions in a direction of an arrangement of the second electrode. The first electrode protrusions are differently arranged at adjacent cross regions.

The present invention also discloses a display panel including an electrode structure in which a plurality of first and second electrodes cross each other forming cross regions at which respective display cells are formed. The display panel includes protrusions which are respectively formed at the cross regions in the direction of the arrangement of the second electrodes and the protrusions have different forms for every predetermined number of the second electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

The present invention will be described in detail with reference to exemplary embodiments of the structure of the display panel and function thereof illustrated with reference to the accompanying drawings.

For convenience, the description of exemplary embodiments of the present invention is made with reference to a three-electrode surface discharging type AC PDP. Additionally, the description is based on an address electrode of an AC PDP that includes a protruding portion according to exemplary embodiments of the present invention.

Figure 1:
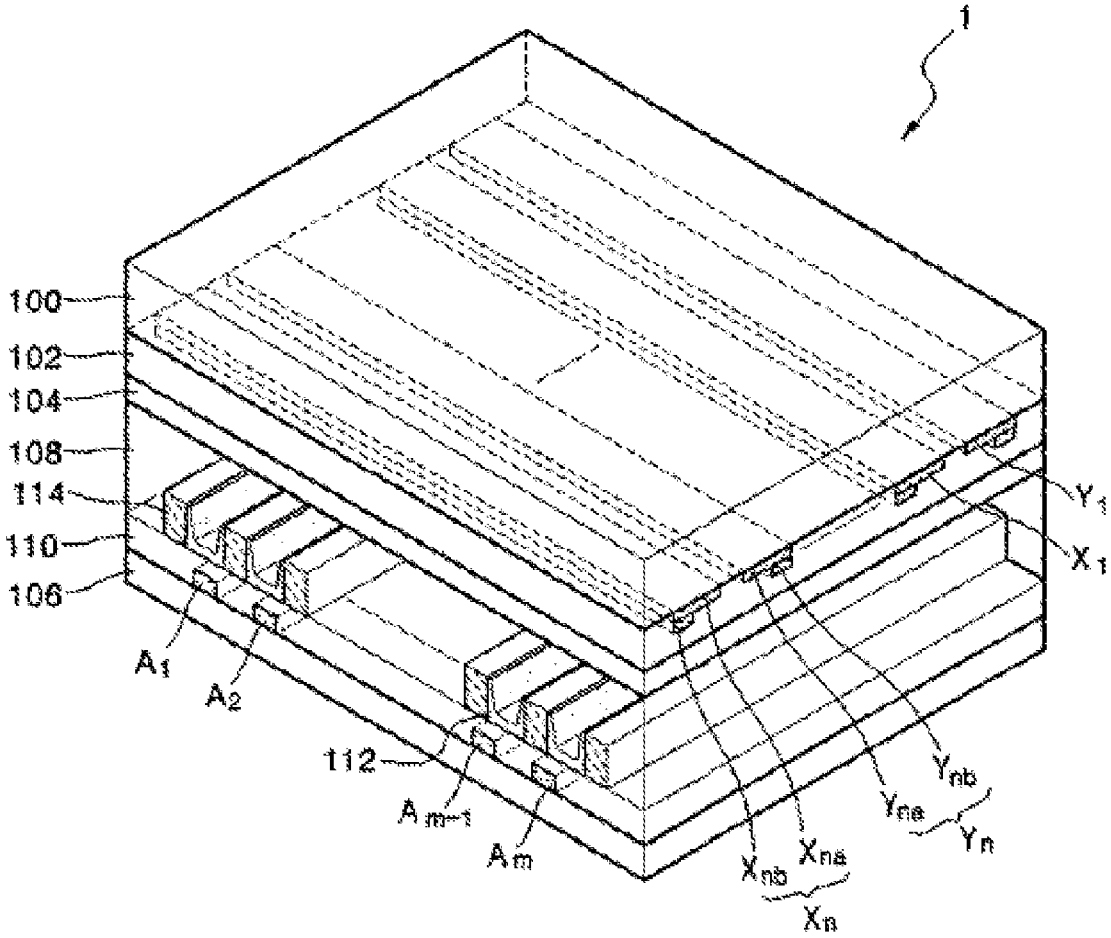
FIG. 1 (PRIOR ART)
FIG. 1 shows the structure of a typical three-electrode surface discharging type plasma display panel (PDP).
Figure 2:
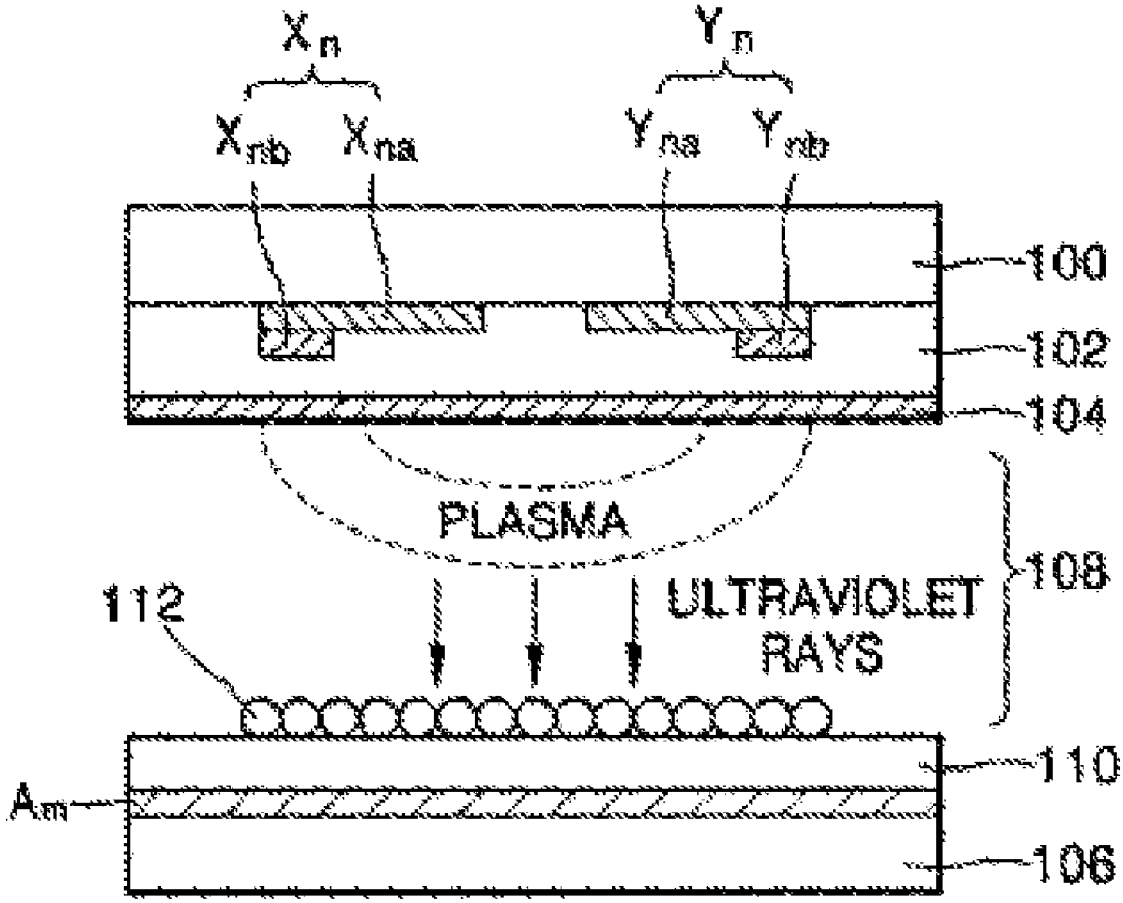
FIG. 2 (PRIOR ART)
FIG. 2 shows an operation of a cell of a panel shown in FIG. 1.
Figure 3:
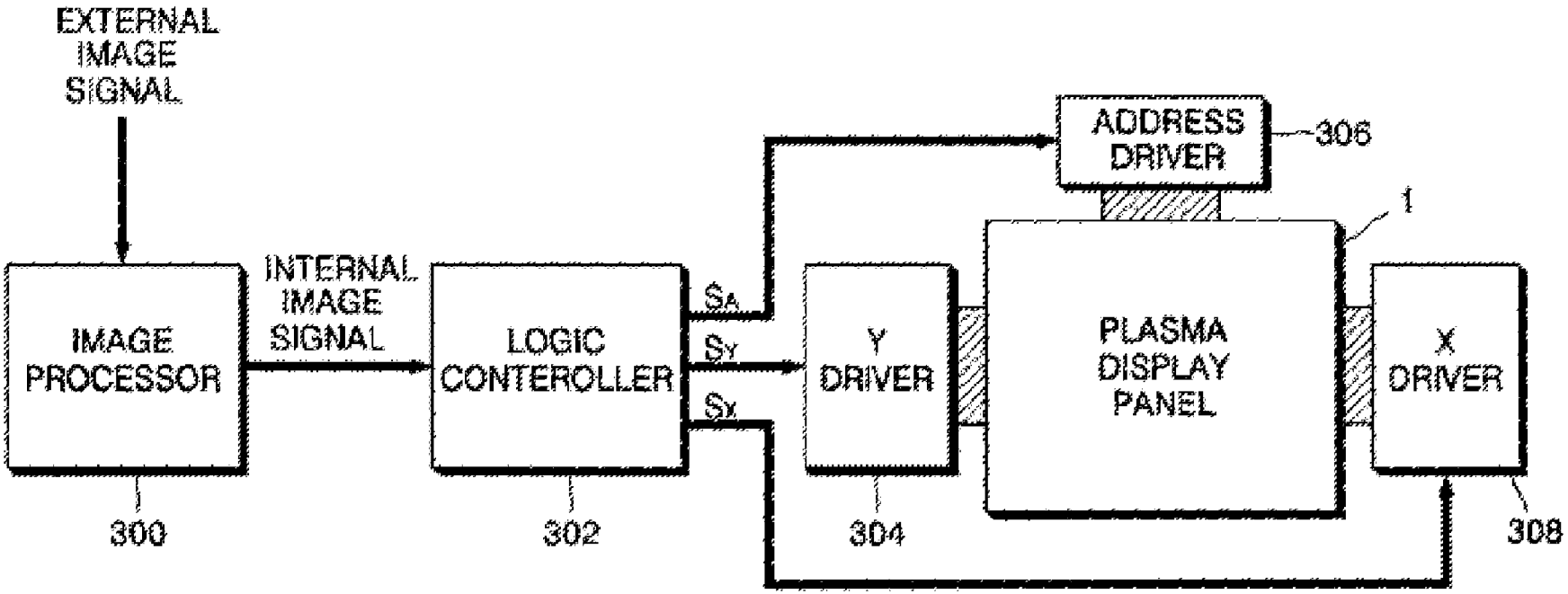
FIG. 3 (PRIOR ART)
FIG. 3 shows a typical drive mechanism for the PDP shown in FIG. 1.
Figure 6:
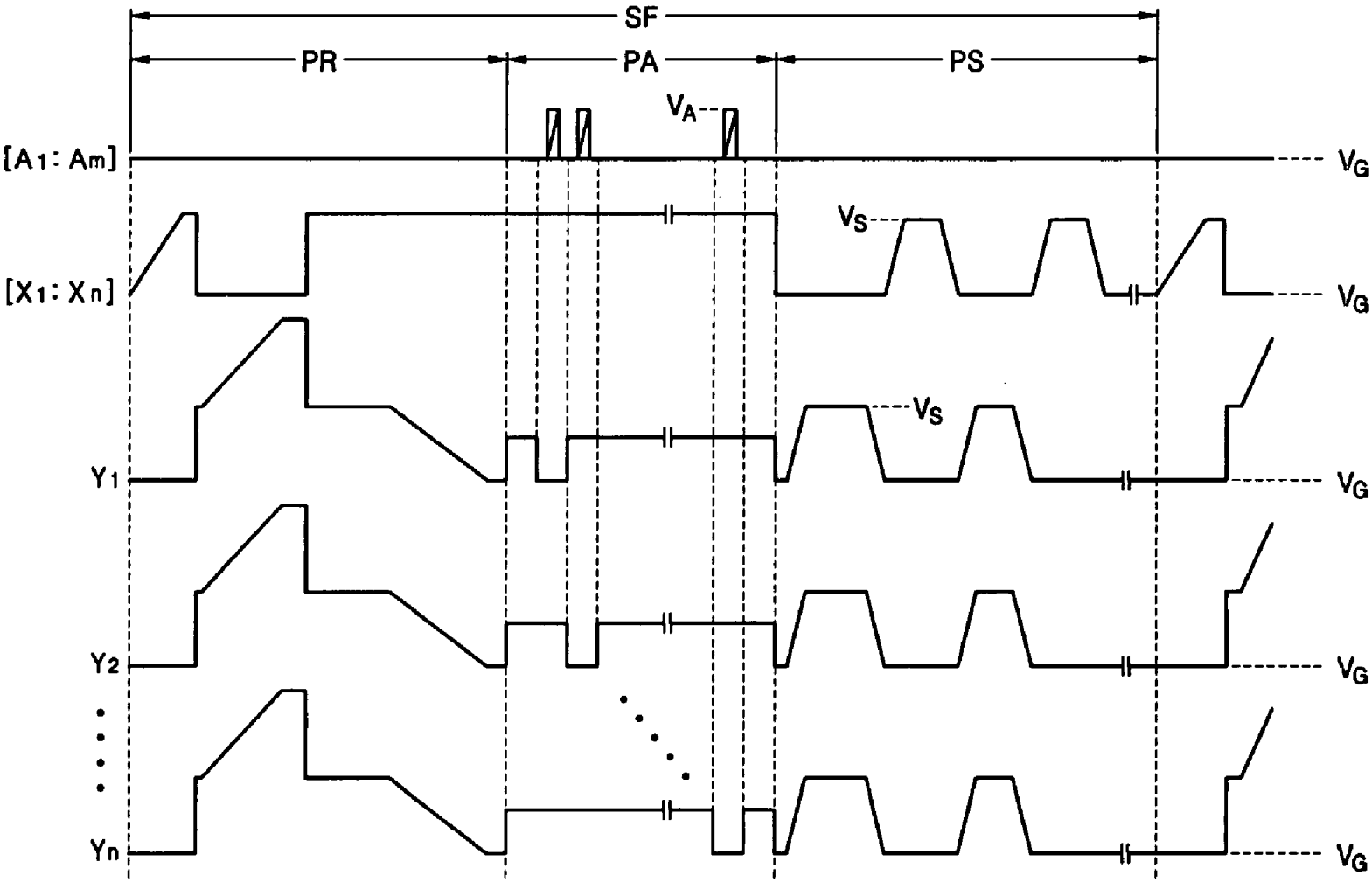
FIG. 6 shows a timing diagram illustrating one example of the drive signal created by the ADS driving method of the display panel shown in FIG. 1 and FIG. 2.

FIG. 6 shows an example of drive signal timing according to the address display separated (ADS) driving method of the display panel shown in FIG. 1 and FIG. 2. FIG. 6 shows drive signals being applied to an address electrode (A), a common electrode (X), and scanning electrodes (Y1~Yn) within a sub-field (SF). Referring to FIG. 6, one sub-field (SF) includes a reset period (PR), an address period (PA), and a discharge-sustaining period (PS).

The reset period (PR), which is carried out before going into the address period, initializes the cells' wall charge state by applying a reset pulse to the scanning line of all groups. The reset period (PR) is carried out across the entire screen, thereby forming a uniform wall charge arrangement for all cells. During the address period, a bias voltage (Ve) is applied to the common electrode (X), and a display cell is selected by simultaneously turning on its corresponding scanning electrode (Y1~Yn) and address electrode (A1~Am). After the address period (PA), a discharge-sustaining period (PS) is carried out by alternately applying a discharge sustaining pulse (Vs) to the common electrode (X) and the scanning electrodes (Y1~Yn). During the discharge-sustaining period (PS), a low level voltage (VG) is applied to the address electrodes (A1~Am). FIG. 6 shows drive signals in which the reset period (PR), address period (PA), and discharge-sustaining period (PS) are carried out as one group in a sub-field. However, a sub-field may be divided into separate groups that may be individually carried out. For example, by dividing scanning electrodes (Y1~Yn) into separate groups, the reset periods (PR), address periods (PA), and discharge sustaining periods (PS) may be carried out by each group. Furthermore, by including a plurality of common electrodes (X), discharge-sustaining periods (PS) may be carried out by each group.

For stable addressing, a wider discharge surface (C), at which an address electrode (A) and scanning electrode (Y) cross, may be required.

Figure 5A:
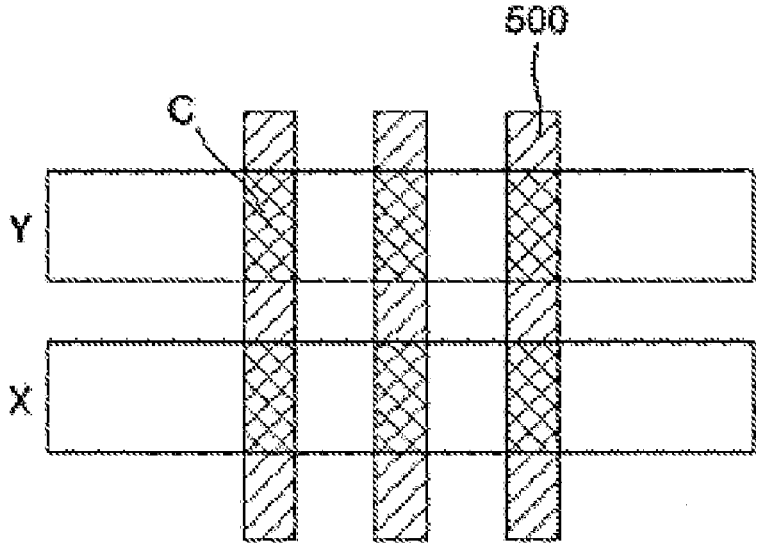
FIG. 5A (PRIOR ART)
FIG. 5*a* shows a stripe type address electrode structure.
Figure 5B:
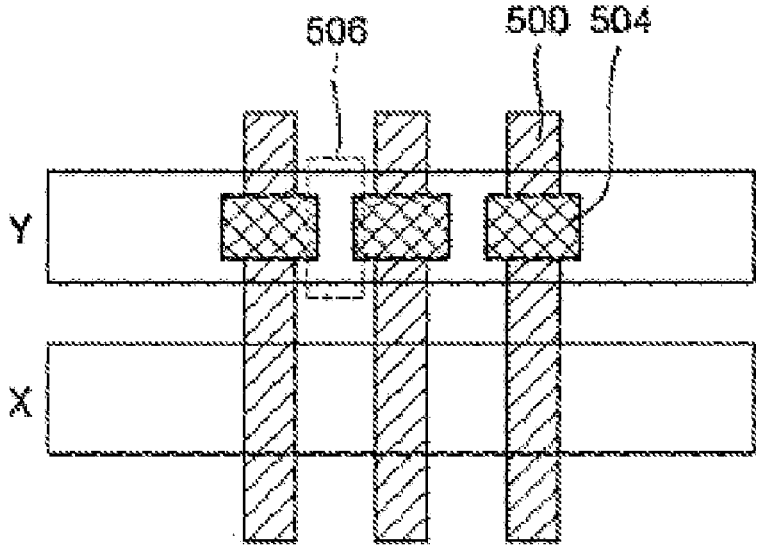
FIG. 5B (PRIOR ART)
FIG. 5*b* shows a protruded type address electrode structure.
Figure 7:
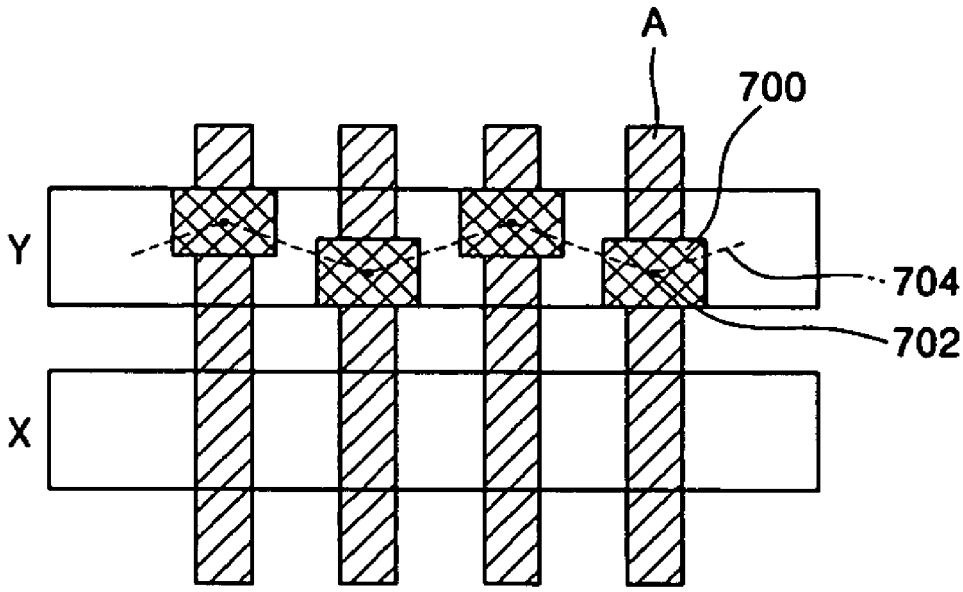
FIG. 7 shows a plan view of an electrode structure of a display panel according to an exemplary embodiment of the present invention.

FIG. 7 shows a plan view of a display panel electrode structure according to an exemplary embodiment of the present invention. The protrusion 700 of FIG. 7 is similar to the protrusion 504 of FIG. 5*b* in that it has a square shape, but the protrusions 700 of FIG. 7 are not arranged in a straight line. In other words, the line 704 connecting the geometric centers 702 of the protrusions 700 is in a zigzag form and not straight. The structure of the protrusions 700 of FIG. 7 may reduce the electrical interference between adjacent address electrodes.

Figure 8:
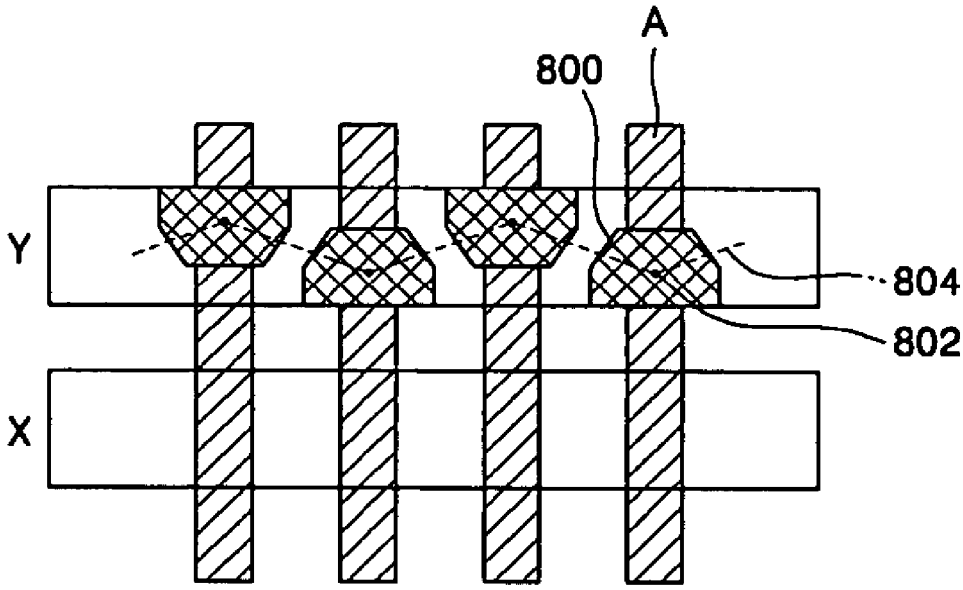
FIG. 8 shows a plan view of an electrode structure of a display panel according to a second exemplary embodiment of the present invention.

FIG. 8 shows a plan view of a display panel electrode structure according to a second exemplary embodiment of the present invention. Unlike FIG. 7, the protrusions 800 are hexagonal. Similar to FIG. 7, the protruding units 800 are not parallel in their arrangement along the direction of the Y electrode. In other words, the connecting line 804 of the geometric centers 802 is in a zigzag form and not straight. Each protruding unit 800 is placed in a position symmetric to the other with respect to the bisector point of the connecting line of the geometric centers between adjacent cells. The form and arrangement of the structure of the protruding units 800 illustrated in FIG. 8 may enable stable addressing by enlarging the discharge surface while reducing electrical interference.

Figure 9:
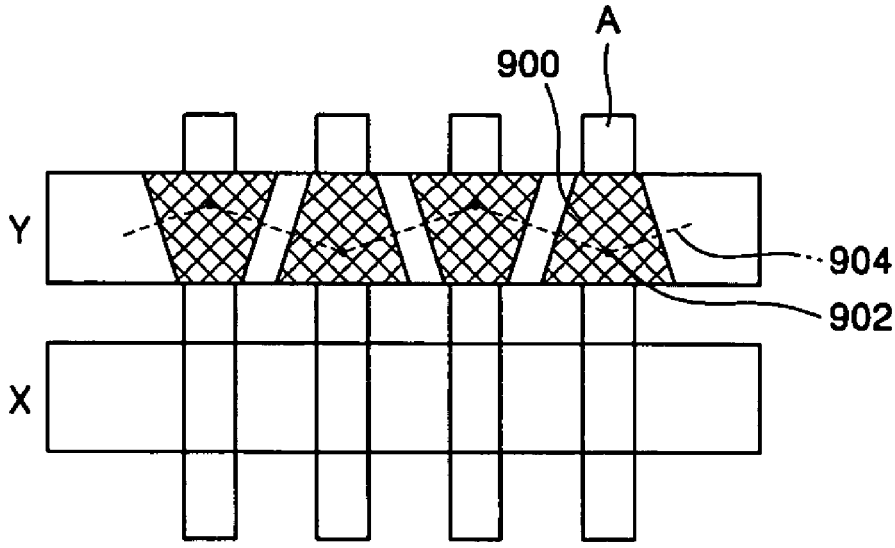
FIG. 9 shows a plan view of an electrode structure of a display panel according to a third exemplary embodiment of the present invention.

FIG. 9 shows a plan view of a display panel electrode structure according to a third exemplary embodiment of the present invention. The shape of the protrusion 900 is a trapezoid. Similar to the embodiments described above, the line 904 connecting the geometric centers 902 of each protruding unit 900 is in a zigzag form, rather than being a straight line parallel to the scanning electrode (Y). Each protruding unit 900 is placed in a position symmetric to the other with respect to the bisector point of the line connecting the geometric centers between adjacent cells. The form and arrangement of the structure of the protruding units 900 illustrated in FIG. 9 may enable stable addressing by enlarging the discharge surface while reducing electrical interference.

Address electrode protrusions may be formed in a layer on top of the address electrode. Preferably, the protrusions are coplanar with the address electrode.

While exemplary embodiments of the present invention are described in terms of a surface discharge type AC PDP, the invention is not limited thereto. The present invention may be applicable to any display device that includes an electrode structure in which a panel displays images by the mutual drive of drive electrodes placed on facing substrates. It is obvious to those skilled in the art that the technology of the present invention may be utilized in other display panels such as, DC PDPs, electroluminescence displays (ELD), liquid crystal displays (LCD), and field emission displays (FED).

Figure 10:
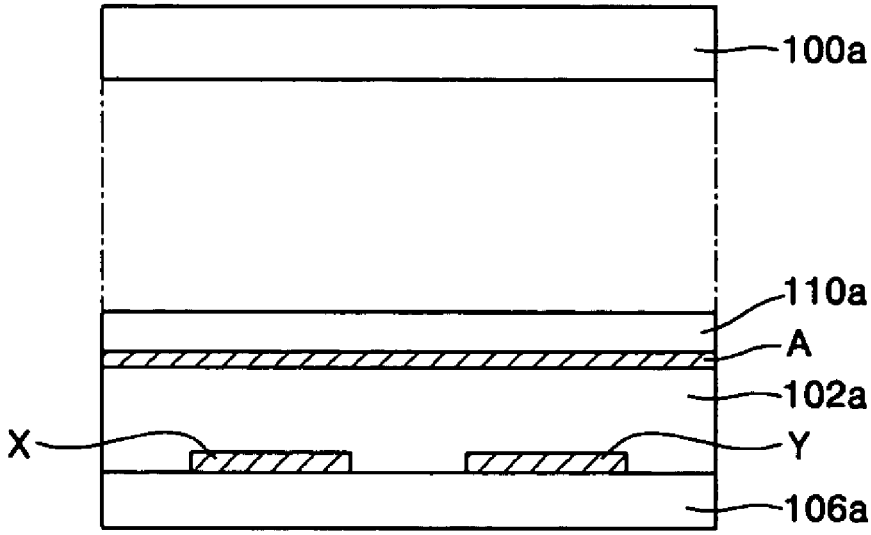
FIG. 10 shows an electrode structure of an upper drive type PDP that may be applied to the present invention.

Furthermore, the above-described exemplary embodiments of the present invention are based on the front driving method of a surface discharging type AC PDP, in which the address electrodes are formed on the lower substrate and scanning electrodes are formed on the upper substrate as shown in FIG. 1 and FIG. 2. However, it is conceivable that the electrode structure of the present invention may be applicable to an upper driving method of a surface discharging type AC PDP as shown in FIG. 10, in which address electrodes (A) and scanning electrodes (Y) are formed on the same substrate 106*a* with dielectric bodies 110*a* and 102*a* interposed therebetween.

Figure 4:
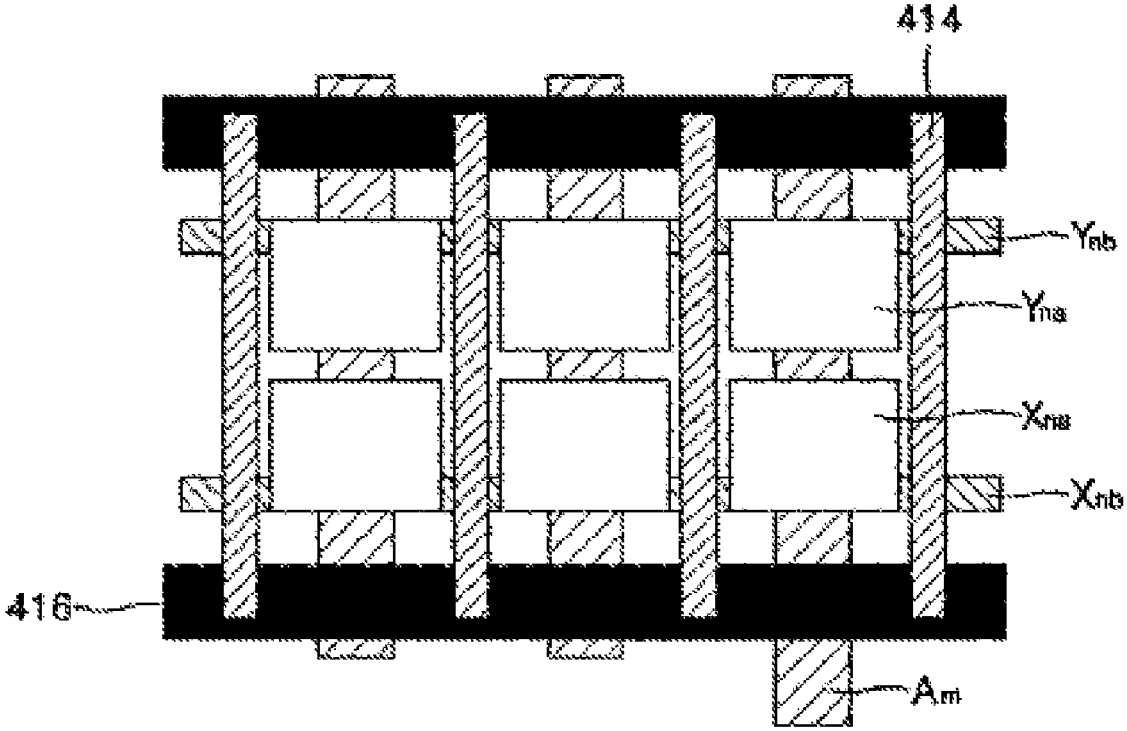
FIG. 4 (PRIOR ART)
FIG. 4 shows a plan view of one example of an electrode structure for the panel shown in FIG. 1.

Additionally, the above-described exemplary embodiments of the present invention are described in terms of stripe shaped scanning (Y) electrodes and common (X) electrodes. Yet, the present invention may also apply to various types of scanning (Y) electrode structures and common (X) electrode structures, such as the electrode structure of FIG. 4.

As described above, according to the display panel of the present invention, the discharge surface formed where the scanning electrodes and address electrodes cross may be increased while maintaining appropriate intervals between the address electrodes. Therefore, stable addressing may be possible while reducing electrical interference among adjacent cells.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display panel, comprising:

a plurality of address electrodes that cross a plurality of scanning electrodes to form cross regions at which display cells are formed, and address electrode protrusions formed at the cross regions, wherein the address electrode protrusions are differently arranged at adjacent cross regions in a direction of the length of the scanning electrodes, wherein a first address electrode protrusion overlaps a first side of a scanning electrode, and wherein a second address electrode protrusion overlaps a second side of the scanning electrode opposite the first side.

2. The display panel of claim 1, wherein a line connecting geometric centers of the address electrode protrusions is in a zigzag form.

3. The display panel of claim 1, wherein two adjacent address electrode protrusions are placed in a position symmetric to each other with respect to a bisector point of a line connecting the geometric centers of the two adjacent address electrode protrusions.

4. The display panel of claim 1, wherein adjacent address electrode protrusions do not have the same shape.

5. The display panel of claim 1, wherein the address electrode protrusions are formed on top of the address electrode.

6. The display panel of claim 1, wherein the address electrode protrusions are coplanar with the address electrode.

7. The display panel of claim 1, wherein an address electrode has more than one protrusion formed at the cross region.

8. The display panel of claim 1, wherein adjacent address electrode protrusions are arranged as mirror images of each other.

9. A display panel including an electrode structure wherein a plurality of address and scanning electrodes cross each other forming cross regions at which respective display cells are formed, the display panel comprising:

address electrode protrusions which are respectively formed at the cross regions in a direction of an arrangement of the scanning electrodes, wherein the address electrode protrusions have different forms for every predetermined number of the address electrodes in a line along a first scanning electrode, wherein a first side of each address electrode protrusion has a length greater than a second side of each address electrode protrusion, wherein the first side is opposite the second side, and wherein the first side of a first address electrode protrusion faces a first direction and the first side of a second address electrode protrusion faces a second direction opposite a first direction.

10. The display panel of claim 9, wherein a line that connects each geometric center of the protrusions is in a zigzag form.

11. The display panel of claim 9, wherein two adjacent protrusions are placed in a position symmetric to each other with respect to a bisector point of a line connecting the geometric centers of the two adjacent protrusions.

* * * * *

UNITED STATES PATENT AND TRADEMARK OFFICE

CERTIFICATE OF CORRECTION

PATENT NO. : 7,586,466 B2
APPLICATION NO. : 10/921829
DATED : September 8, 2009
INVENTOR(S) : Kwon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 861 days.

Signed and Sealed this

Fourteenth Day of September, 2010

David J. Kappos

David J. Kappos
*Director of the United States Patent and Trademark Office*